United States Patent [19]

Sunoo

[11] 4,047,310

[45] Sept. 13, 1977

[54] FATIGUE RELIEVING FOOT APPLIANCE

[76] Inventor: Hyeng P. Sunoo, 20 Greenwood Way, Monterey, Calif. 93940

[21] Appl. No.: 677,946

[22] Filed: Apr. 19, 1976

[51] Int. Cl.[2] ..... A43B 3/12

[52] U.S. Cl. ..... 36/11.5; 128/582

[58] Field of Search ..... 36/11.5, 43, 8, 1; 128/582, 614, 615

[56] References Cited

U.S. PATENT DOCUMENTS

| | | | |
|---|---|---|---|
| 3,595,244 | 7/1971 | Kugler | 36/11.5 |
| 3,603,006 | 9/1971 | Davenport | 36/11.5 |
| 3,722,113 | 3/1973 | Birkstock | 36/11.5 |
| 3,757,774 | 9/1973 | Hatuno | 128/582 |
| 3,859,727 | 1/1975 | Nakamoto | 36/11.5 |

FOREIGN PATENT DOCUMENTS

| | | | |
|---|---|---|---|
| 2,024,534 | 5/1970 | Germany | 36/11.5 |

*Primary Examiner*—Patrick D. Lawson

*Attorney, Agent, or Firm*—Townsend and Townsend

[57] ABSTRACT

A podiatric device is provided comprising a sandal having a resilient insole moulded to the contour of the plantar surface of the foot, moderately raised under the metatarsal arch of the foot having a plurality of uniformly distributed rigid studs extending upwardly from said insole. The studs extend a moderate distance from the insole's surface and have rounded heads. The studs are set in alternating staggered columns. The sandal aids in relieving fatigue, massaging the feet, and in improving the kidney function.

10 Claims, 4 Drawing Figures

FATIGUE RELIEVING FOOT APPLIANCE

BACKGROUND OF THE INVENTION

1. Field of the Invention

The well-being of the foot is important to the mental and physical health of the individual. Active people or people who stand on their feet for long periods of time find that their feet become tired and sore. This fatigue is frequently translated to the rest of the body.

It is therefore desirable to provide a simple means for massaging the foot while promoting blood circulation and strenghtening the muscles. A sandal is a particularly convenient device, since at the end of the day or at other times when the foot is fatigued or sore, the sandal can be worn to relieve the fatigue and massage the feet to provide a sense of well being and comfort. Also, by massaging the area in the arch and providing support for the arch, improvement in the kidney function is achieved.

2. Description of the Prior Art

U.S. Pat. No. 3,595,244 depicts a sandal having a plurality of ridges of varying lengths, heights, and disposition. U.S. Pat. No. 2,734,286 depicts a sandal having a plurality of cylindrical ridges uniformly placed on the insole. U.S. Pat. 2,400,023 depicts a foot massaging device comprising a boot having a layer of loose granular material.

SUMMARY OF THE INVENTION

A podiatric sandal is provided having a relatively non-resilient base and a resilient insole with a plurality of protuberances having rounded heads and distributed substantially uniformly over the resilient insole. The protuberances are of a rigid material, their distribution being substantially uniform in staggered columns extending substantially the length of the insole. The insole conforms substantially to the plantar surface except for being mildly elevated under the metatarsal arch of the foot.

DESCRIPTION OF THE SPECIFIC EMBODIMENTS

A podiatric device is provided comprising a support, a resilient insole conforming to the contour of the plantar surface of the foot, being slightly elevated under the metatarsal arch and having a plurality of substantially evenly distributed non-resilient protuberances. The protuberances are arranged in substantially evenly spaced staggered columns, having rounded heads for contacting the plantar surface. The outer sole of the sandal may be flat or have a heel and may be comprised of leather, rubber, or other relatively nonresilient composition of known kind, commonly used in foot wear e.g. crepe.

The insole or innersole is of a resilient material, which is conveniently a foamed plastic, such as polyvinyl chloride, polyethylene, polyurethane or the like. The surface of the insole preferably has a dense skin which can be readily cleaned, is durable, and will retain the desired contour. The protuberances are of a rigid plastic e.g. polyethylene, polypropylene, polyvinyl chloride, polyester, or the like. The inner sole will usually be at least $\frac{1}{8}$ inch, generally at least $\frac{1}{4}$ inch thick, and may be substantially thicker, usually not exceeding $\frac{3}{4}$ inch in thickness.

The sandal may have a front and rear strap or only a front strap which may be attached to the outer sole by conventional means.

Alternatively, the insole may be provided independently of an outer sole and be introduced into a shoe. In such an instance, the thickness of the insole will generally be at least about 1mm, preferably at least about 2mm, and not exceeding about 5mm. The intent is to have sufficient thickness to provide structural integrity and allow for substantial use and wearing, without unduely crowding the foot in the shoe. Where the insole is provided separately from the outer sole, the protuberances will generally be in the lower portion of the range. In addition, in those areas to be described subsequently, which do not require massaging, protuberances will either be small or left out completely.

Figure 2:
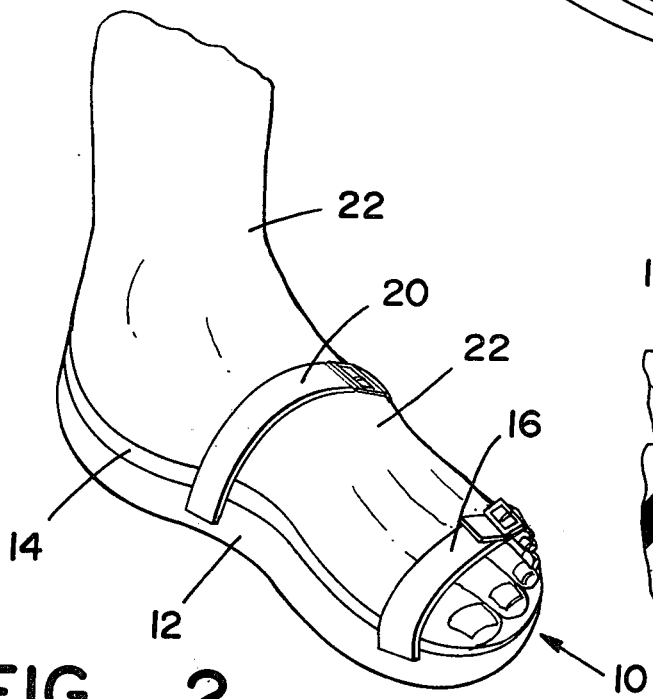
FIG. 2 is a side view of the sandal in proper position upon a human foot.
Figure 3:
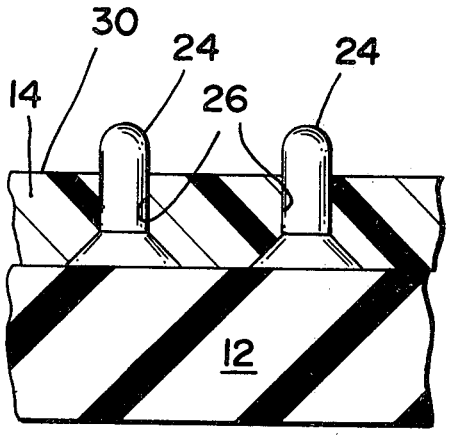
FIG. 3 is a fragmentary transverse sectional view of a protuberance extending from the insole and the outer sole.

As shown in FIG. 2, the sandal 10 has an outer sole 12 which may be flat as depicted or may have a heel. Bonded to the outer sole 12 is an inner sole 14 which substantially conforms to the contour of the plantar surface of the foot. The sandal has a forward strap 16 and a rear strap 20 for holding the sandal to the foot 22. As indicated previously, only the forward strap is necessary, although it is desirable to have both straps so as to maintain continuous contact of the sandal to the entire length of the foot. The straps may be bonded to the outer sole 12 by any conventional means.

Figure 1:
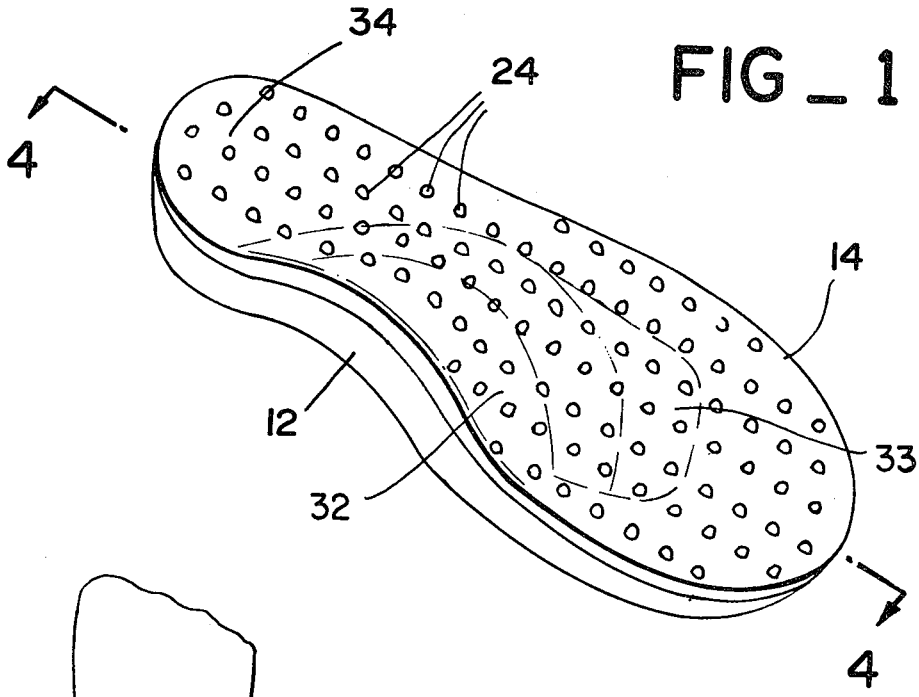
FIG. 1 is a perspective view looking downwardly from the side of the sandal of this invention shown strapless for greater detail.

Extending upwardly from the inner sole are a plurality of protuberances 24. As depicted in FIG. 1, the protuberances are arranged in alternating staggered rows extending substantially the length of the inner sole 14. The protuberances will generally be spaced from about 3 to 6mm apart in any row, with each of the rows being spaced about 3 to 6mm apart. Preferably, the protuberances are spaced apart in each row about 4mm and each row is spaced from the next row about 4mm. Protuberances may not be included in certain areas or may be substantially shortened in such areas as around the os calcis of the heel, between the first and fifth metatarsal heads of the foot.

The protuberances will be of a hard plastic and are conveniently shaped as round headed cones or cylinders with the diameter of the head being about 1.5–2.5mm, preferably about 2mm. The protuberances extend from the sole surface, extend upward at least about 2mm and not more than about 6mm, usually about 3 to 5mm. All of the protuberances will generally be about the same height above the outer sole.

The protuberances 24 can be bonded to the inner sole 14 by any convenient means. As shown in FIG. 2, preferably, the inner sole 14 is adapted to receive the protuberances, particularly by forming the inner sole with a plurality of openings 26. The protuberances 24 may then be bonded to the outer sole 12 and extend through the inner sole 14 the desired distance from the surface 30 of the inner sole 14. Alternatively, the inner sole may be molded as a single unit, whereby the inner sole is foamed so as to provide a resilient base, while the protuberances are molded in solid form, so as to provide a rigid structure.

Figure 4:
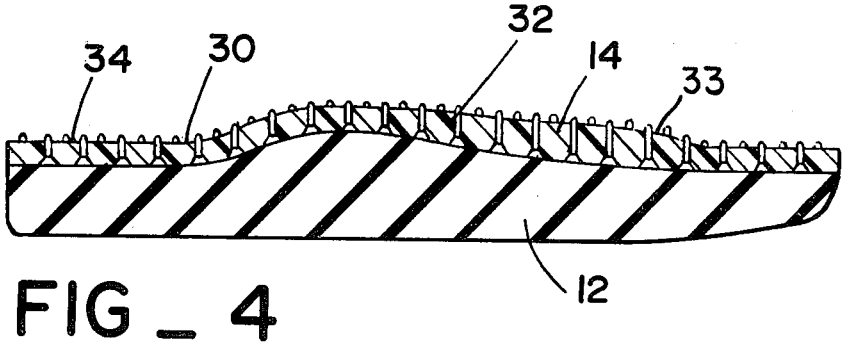
FIG. 4 is a fragmental longitudinal vertical sectional view taken substantially as indicated by the line 4—4 of FIG. 1.

Turning now to FIG. 4 in conjunction with FIG. 1, the surface of the inner sole 14 is contoured so as to substantially conform to the plantar surface of the sole. However, the area 32 under the metatarsal arch is elevated about 1.5–3.5mm, preferably from about 2 to 3mm from the normal contour, with the surface 30 of the insole 14 then smoothly returning to the contour of the plantar surface.

In addition, that area between the second and forth metatarsals or foot bones and adjacent the ligaments joining the metatarsal to the phalanges (area 33) is also slightly rised generally from about 1 to 4mm, more usually from about 1 to 3mm from the normal contour of the foot.

The heel 34 may be mildly depressed or may be relatively flat, since the main support of the calcaneus bone is derived from the protuberances 24 which transfer the weight of the foot to the outer sole 12.

The protuberances provide a massaging action to the foot, giving support to the foot. The resilient inner sole is able to accept the fleshly portions of the foot which extend beyond the protuberances, and at the same time absorb part of the weight of the body. The sandal can be economically produced and acts as a salutary means for relieving fatigue, improving blood circulation, stimulating the muscles, and improving the kidney function.

Although the foregoing invention has been described in some detail by way of illustration and example for purposes of clarity of understanding, it will be obvious that certain changes and modifications may be practiced within the scope of the appended claims.

What is claimed is:

1. A podiatric sandal for relieving foot fatigue comprising:

an outer sole;

an inner sole of resilient material supported by the outer sole substantially conforming to the contour of the plantar surface of the foot except for being mildly elevated in selected massaging areas defined by the area under the metatarsal arch and between the second and fourth metatarsal;

a plurality of rigid, rounded-head protuberances substantially uniformly distributed in said massaging areas in staggered columns extending above said inner sole for encountering said plantar surface; and at least one strap bonded to said outer sole for mounting on the foot.

2. A podiatric sandal according to claim 1, wherein said protuberances extend above said inner sole from about 2 to 6mm, and the radius of the rounded head is in the range from about 1.5 to 2.5mm.

3. A podiatric sandal according to claim 2, wherein said protuberances extend upwards from about 3 to 5mm and the radius of said rounded head is about 2mm.

4. A podiatric sandal according to claim 2, wherein the protuberances are spaced apart from about 3 to 6mm in said columns and each of said columns is spaced apart from about 3 to 6mm.

5. A podiatric sandal according to claim 4, wherein each of the protuberances is spaced apart in each column about 4mm and each of said columns is spaced apart about 4mm.

6. A podiatric sandal according to claim 1, wherein said protuberances consist essentially of a hard moulded plastic.

7. A podiatric sandal according to claim 1, wherein said protuberances extend through said inner sole and are bonded to said outer sole.

8. A podiatric sandal for relieving foot fatigue comprising:

an outer sole; an inner sole bonded to said outer sole, said inner sole being of resilient material and having a thickness of at least about ⅛ inch and substantially conforming to the contour of the plantar surface of the foot except for being elevated from about 2 to 3mm at the maximum from the normal contour in a massaging area under the metatarsal arch and between the second and fourth metatarsal; a plurality of rigid, rounded-head protuberances substantially uniformly distributed in the massaging area in staggered columns spaced apart about 4mm, said protuberances being spaced apart in each of said columns about 4mm and extending above said inner sole from about 3 to 5mm; and at least one strap connected to said outer sole for mounting on the foot.

9. A shoe insert for relieving foot fatigue and massaging the foot comprising;

an inner sole of a resilient material, said inner sole having a thickness of from about 1 to 5mm of substantially resilient material and shaped substantially conforming to the contour of the plantar surface of the foot except for being mildly elevated under the metatarsal arch and between the second and fourth metatarsal, and having a plurality of rigid, rounded-head protuberances substantially uniformly distributed in the area under the metatarsal arch and between the second and fourth metatarsal in staggered columns extending above said inner sole.

10. An insert according to claim 9, wherein said protuberances extend above said inner sole for about 1 to 5mm and the radius of the rounded head is in the range from about 1.5 to 2.5mm and when the protuberances are spaced apart from about 3 to 6mm in said columns and each of said columns is spaced apart from about 3 to 6mm.

* * * * *